US005569140A

United States Patent [19]

Elliman

[11] Patent Number: 5,569,140

[45] Date of Patent: Oct. 29, 1996

[54] EXERCISE DEVICE

[75] Inventor: Andrew P. Elliman, Victoria, Australia

[73] Assignee: Great Southern Co. Proprietary Limited, West Brunswick, Australia

[21] Appl. No.: 457,358

[22] Filed: Jun. 1, 1995

[51] Int. Cl.[6] ..... A63B 23/02

[52] U.S. Cl. ..... 482/140

[58] Field of Search ..... 482/140, 904, 482/148, 39, 40, 145; 248/227, 304, 339, 307

[56] References Cited

U.S. PATENT DOCUMENTS

| | | | |
|---|---|---|---|
| 3,178,180 | 4/1965 | Morgan | 482/145 |
| 3,193,229 | 7/1965 | Stock | 248/304 |
| 4,323,235 | 4/1982 | Schwarz | 482/140 |
| 5,413,297 | 5/1995 | Adams | 248/304 |

FOREIGN PATENT DOCUMENTS

77291/91 11/1991 Australia .

*Primary Examiner*—Stephen R. Crow
*Attorney, Agent, or Firm*—Michael, Best & Friedrich

[57] ABSTRACT

An exercise device is disclosed which has a base (12) and in integral inclined section (14) extends upwardly and outwardly from the base. The inclined section (14) has a body support section (16) for supporting ankle straps or the like for supporting a person's ankle. The base (12) has an upstanding wall (30) so that the base can be arranged on a bottom part of a door while locating the door between the upstanding wall (30) and the inclined portion (14) so that the device is secured to the door.

14 Claims, 2 Drawing Sheets

EXERCISE DEVICE

This invention relates to an exercise device, and in particular, to an exercise device which is small and compact and can be easily transported and used in conjunction with a door to facilitate physical activity, such as situps, by a user.

The invention may be said to reside in an exercise device comprising:

a base section;

an outwardly extending section extending outwardly from the base section;

a body support portion for supporting a body support so that part of a person's body can be supported by the body support;

an abutment member extending from the base;

a space between the abutment member and the outwardly extending section; and wherein the exercise device is adapted to be supported by a door by sliding the exercise device relative to an edge of a door so that the door is arranged in the space between the abutment member and the outwardly extending section and wherein the abutment member engages the door to support the device when a person exercises.

Since the exercise device cooperates with a door for support the device can be made quite small and therefore it is easy to transport. A user can transport the device and reengage it with a door at any desired location to facilitate exercise by the user.

Preferably the outwardly extending section includes a back member which is inclined with respect to the base and a web which is connected to the back member and extends substantially at right angles to the back member from the base and along the back member.

Preferably the abutment section comprises a wall extending substantially at right angles from the base and arranged intermediate the inclined web and an end of the base so that said space is defined between the wall and the inclined web.

Preferably a web is arranged between the end of the base and the wall.

Preferably the body support section is integral with the outwardly extending section and comprises a first portion extending away from the outwardly extending section and a second portion which extends back towards the inclined section, a U-shaped transition portion extending between the first and second sections so that the first and second sections form a clip for receiving the body support.

Preferably the body support comprises ankle straps for supporting the ankle of a user.

In alternative embodiments the body support section could be configured differently to accommodate different types of body supports for facilitating different types of exercises. For example, the support section could be configured to support a bar for chin ups or like exercises.

Preferably the device is moulded from plastic and the base, wall section, inclined section and body support section are integral with one another.

A preferred embodiment of the invention will be described, by way of example, with reference to the accompanying drawings in which.

Figure 1:
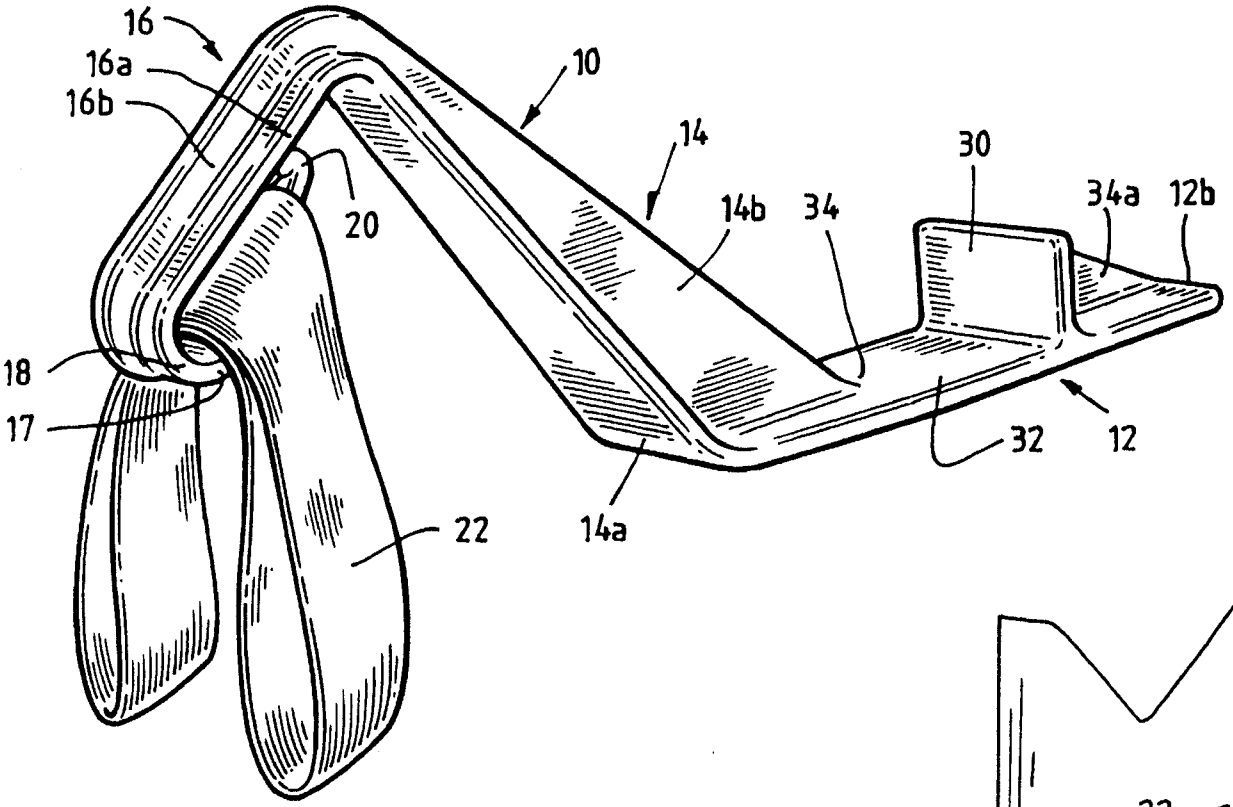
FIG. 1 is a perspective view of a device embodying the invention.

With reference to FIG. 1 the exercise device 10 comprises a base 12 which is generally planar and which has a slightly angled section 12*a* at one end and a free end 12*b* at the other end. The base 12 is in the form of a strip of plastics or like material. An inclined section 14 extends upwardly from the base and includes a back portion 14*a* which is generally integral and forms a continuation of the base 12 and a web 14*b* which extends from the base 12 along the length of the member 14*a*.

A body support section 16 is supported by the inclined section 14 at its end remote from the base 12 and generally comprises a back member 16*a* which is a continuation of the back member 14*a* and a web portion 16*b* which is a continuation of the web 14*b*. The base support section 16 also includes a section 17 which extends back towards the inclined section 14 and which is joined to the section 16 by a U-shaped transition 18. A bulb 20 is formed at the end of the section 17 and the support section 16 is therefore configured in the form of a clip for receiving ankle straps 22 which can be inserted between the sections 16*a* and 17 by slightly deforming the section 17 away from the section 16 if necessary and with the straps 22 being generally held in place by the bulb 20.

A wall 30 extends upwardly from the base 12 intermediate the inclined section 14 and the free end 12*b* of the base. A space 32 is therefore defined between the wall 30 and the innermost point 34 of the web 14*b*. The space 32 is dimensioned so that it will accommodate the thickness of a door 50 (see FIGS. 2 and 3) as will be described in greater detail hereinafter.

A web 34 extends between the free end 12*b* of the base 12 and the wall 30.

Figure 2:
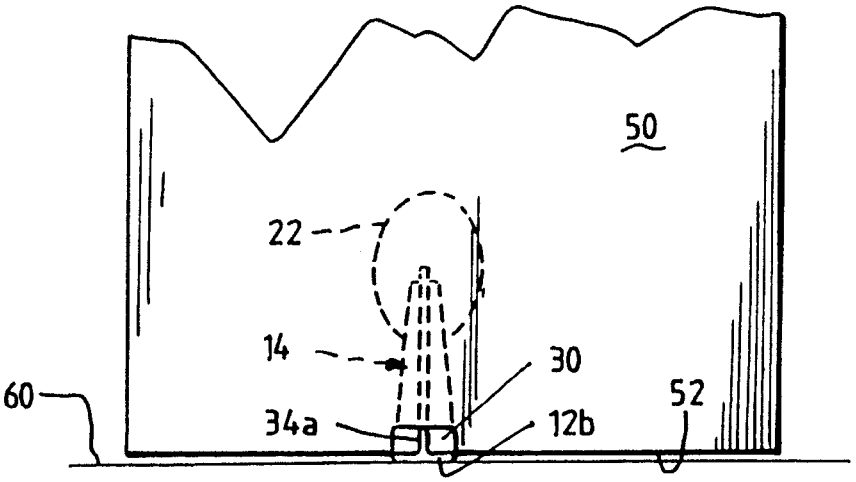
FIG. 2 is a view of the device engaging a door.
Figure 3:
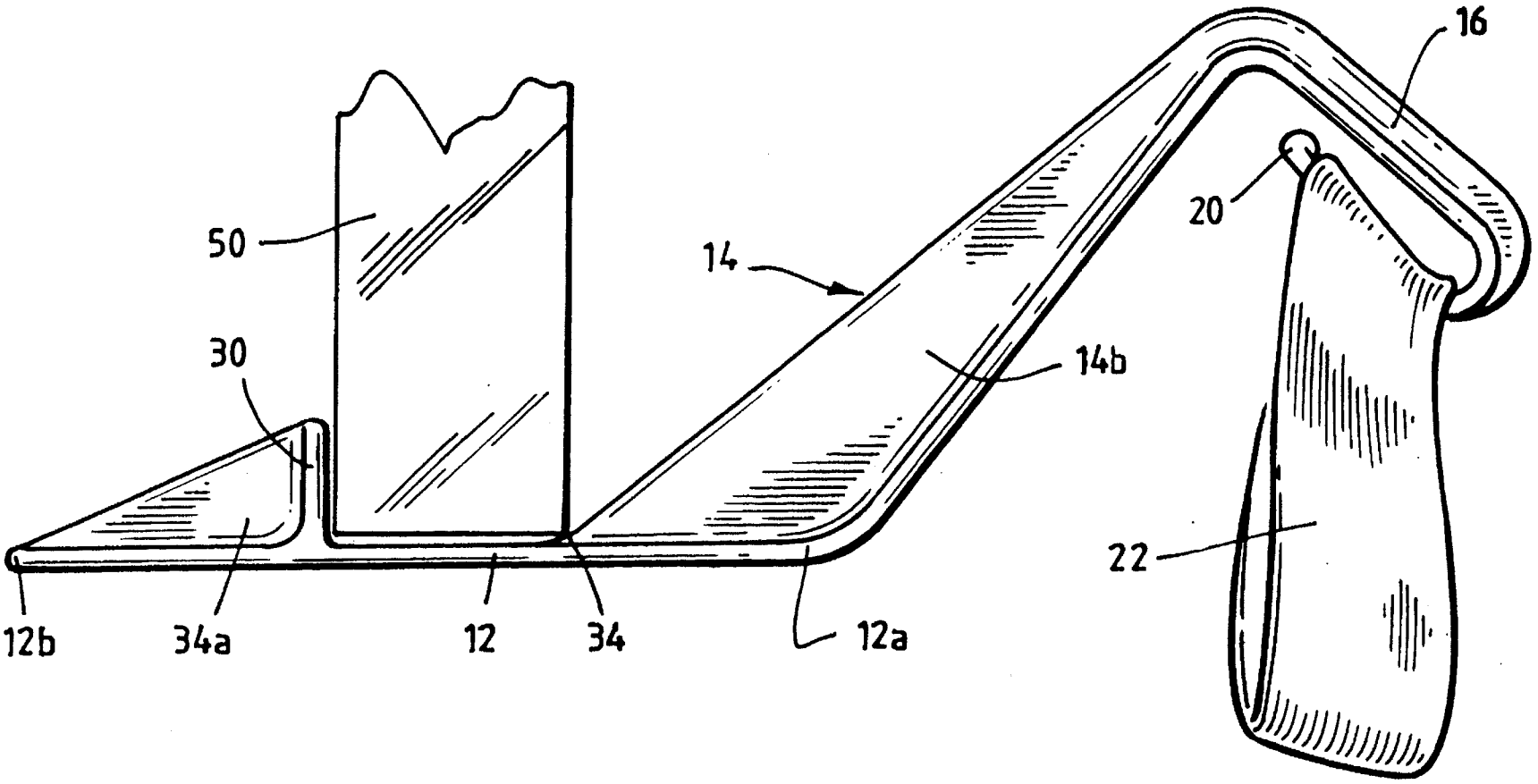
FIG. 3 is a view along the line III—III of FIG. 2.

To use the device 10 the device is engaged with a door as is shown in FIGS. 2 and 3. With reference to FIGS. 2 and 3 to engage the device with a door the door is opened and the device is slid in the direction of arrow A in FIG. 2 so that the bottom of the door is received in the space 32 between the wall 30 and the innermost tip 34 of the web 14*b*. The wall 30 therefore forms an abutment portion for engaging the door and supporting the device for use by a user.

In order to use the device the door 50 is closed with the device 30 arranged on the bottom of the door with the wall 30 generally abutting one side of the door and the base 12 arranged between a floor 60 and the bottom 52 of the door. With the door closed a user can locate his or her ankles in the ankle straps 22 and can perform situps with ankles being supported in the straps 22 and by the device 10. During exercise the wall 30 abuts the door 50 so as to prevent movement of the device and therefore holds the device and the person's ankles in position during performance of the exercise.

In other embodiments of the invention it would be possible to engage the device 10 with a top of the door rather than the bottom so that the device could be used to support a bar or other hand grips so that chinups or like exercises could be performed. In this embodiment of the invention the ankle straps 22 could be used as hand grips or, alternatively, the support section 16 could be configured to receive a bar or the like so that chinups could be performed.

The exercise device can be moulded from plastics material and is therefore relatively inexpensive and furthermore it can be made sufficiently small so that it can be easily transported by a user so that the user can use the device at home, at the office or in hotels for facilitating exercise.

Since modifications within the spirit and scope of the invention may readily be effected by persons skilled within the art, it is to be understood that this invention is not limited to the particular embodiment described by way of example hereinabove.

The clains defining the invention are as follows:

I claim:

1. An exercise device for installing between a bottom edge of a door and a floor, comprising:

a base section in use disposed on the floor;

an outwardly extending section extending outwardly from the base section;

a body support portion coupled to the outwardly extending section for supporting a body support so that part of a person's body can be supported by the body support;

an abutment member extending from the base;

a space between the abutment member and the outwardly extending section; and wherein the exercise device is adapted to be supported by the door by sliding the exercise device relative to the bottom edge of the door so that the door is arranged above the base section in the space between the abutment member and the outwardly extending section, the outwardly extending section extends outwardly from a point adjacent the bottom edge of the door and the abutment member engages the door to support the device when a person exercises.

2. The device of claim 1 wherein the outwardly extending section includes a back member which is inclined with respect to the base and a web which is connected to the back member and extends substantially at right angles to the back member from the base and along the back member.

3. The device of claim 2 wherein the abutment section comprises a wall extending substantially at right angles from the base and arranged intermediate the web and an end of the base so that said space is defined between the wall and the web.

4. The device of claim 3 wherein a support web is arranged between the end of the base and the wall.

5. The device of claim 1 wherein the body support portion is integral with the outwardly extending section and comprises a first portion extending away from the outwardly extending section, a second portion which extends back towards the outwardly extending section, and a U-shaped transition portion extending between the first and second sections so that the first and second sections form a clip for receiving the body support.

6. The device of claim 1 wherein the body support comprises straps for supporting the feet of a user.

7. The device of claim 1 wherein the device is moulded from plastic and the base, the abutment member, the outwardly extending section and the body support portion are integral with one another.

8. A method of exercising, said method comprising the steps of (a) providing an exercise device for installing between a bottom edge of a door and a floor, the device including: a base section; an outwardly extending section extending outwardly from the base section; a body support portion coupled to the outwardly extending section for supporting a body support so that part of a person's body can be supported by the body support; an abutment member extending from the base; and a space between the abutment member and the outwardly extending section;

(b) sliding the exercise device relative to the bottom edge of the door so that the base section is disposed on the floor and the door is arranged above the base section in the space between the abutment member and the outwardly extending section, the outwardly extending section extends outwardly from a point adjacent the bottom edge of the door, and the abutment member engages the door to support the device when a person exercises; and (c) using the body support portion to support a part of a person's body when the person exercises.

9. The method of claim 8 wherein step (a) includes providing the outwardly extending section with a back member which is inclined with respect to the base and a web which is connected to the back member and extends substantially at right angles to the back member from the base and along the back member.

10. The method of claim 8 wherein step (a) includes providing the abutment section with a wall extending substantially at right angles from the base and arranged intermediate the web and an end of the base so that said space is defined between the wall and the web.

11. The method of claim 10 wherein step (a) includes providing a support web arranged between the end of the base and the wall.

12. The method of claim 8 wherein step (a) includes providing the body support portion integral with the outwardly extending section and comprising a first portion extending away from the outwardly extending section, a second portion which extends back towards the outwardly extending section, and a U-shaped transition portion extending between the first and second sections so that the first and second sections form a clip for receiving the body support.

13. The method of claim 8 wherein step (a) includes providing the body support with straps for supporting the feet of the person using the device, and wherein step (c) includes placing the feet of the person in the straps.

14. The method of claim 8 wherein step (a) includes moulding the device from plastic such that the base, the abutment member, the outwardly extending section and the body support portion are integral with one another.

* * * * *